United States Patent [19]

Brusutti

[11] Patent Number: 4,949,686

[45] Date of Patent: Aug. 21, 1990

[54] SEALING ELEMENT FOR A ROTARY TIMING SYSTEM OF INTERNAL-COMBUSTION ENGINES

[76] Inventor: Giancarlo Brusutti, Via Terraglio, 73, 31021 Mogliano Veneto, Italy

[21] Appl. No.: 425,258

[22] Filed: Oct. 23, 1989

[30] Foreign Application Priority Data

Oct. 26, 1988 [IT] Italy ..... 41698 A/88

[51] Int. Cl.[5] ..... F01L 7/00

[52] U.S. Cl. ..... 123/190 E; 123/190 BD

[58] Field of Search ..... 123/190 BD, 190 E

[56] References Cited

U.S. PATENT DOCUMENTS

| | | | |
|---|---|---|---|
| 1,536,733 | 5/1925 | Symonds | 123/190 E |
| 1,660,166 | 2/1928 | Hulse | 123/190 E |
| 1,757,302 | 5/1930 | Frazier | 123/190 BD |
| 1,977,025 | 10/1934 | Vander Elst et al. | 123/190 E |
| 2,048,134 | 7/1936 | Montalto | 123/190 BD |
| 2,857,902 | 10/1958 | Vorst | 123/190 BD |
| 3,948,227 | 4/1976 | Guenther | 123/190 BD |
| 4,506,636 | 3/1985 | Negre et al. | 123/190 E |
| 4,834,038 | 5/1989 | Montagni | 123/190 BD |

*Primary Examiner*—E. Rollins Cross

*Attorney, Agent, or Firm*—Guido Modiano; Albert Josif

[57] ABSTRACT

A plurality of sealing elements is accommodated in seats provided on the engine head and on a case which contains a rotary distribution cylinder. The sealing element is substantially composed of a widened head, the upper face whereof is shaped complementarily to the surface of the distribution cylinder; a body with a smaller cross section is connected to the head's lower face. The head and body of the sealing element have a quadrangular cross section and are arranged parallel to the distribution cylinder. The head and the body are axially traversed by at least two parallel holes which connect the engine's combustion chamber and corresponding chambers of the distribution cylinder and connect these chambers to the induction and exhaust manifolds. The body of the sealing element is provided with perimetral grooves for rings which constitute sliding seals on the seat in which the element is accommodated.

7 Claims, 3 Drawing Sheets

SEALING ELEMENT FOR A ROTARY TIMING SYSTEM OF INTERNAL-COMBUSTION ENGINES

BACKGROUND OF THE INVENTION

The present invention relates to a sealing element for a rotary timing system of internal-combustion engines.

Internal-combustion engines are already known in which a rotary timing system replaces the conventional timing system, composed of valves actuated by camshafts.

A type of rotary timing system is disclosed in the U.S. patent application No. 575,640 filed on Jan. 30, 1984 in the name of the same Applicant.

This timing system comprises a hollow distribution cylinder which is divided into internal chambers, two for each cylinder. Each of the chambers has at least two ports and the cylinder rotates synchronously with the crankshaft.

Intermediate sealing elements slide on the distribution cylinder with one of their faces, which is shaped complementarily thereto. The sealing elements are arranged in diametrically opposite rows.

Each of said sealing elements is arranged into holes or ports provided on the engine head and on a body which contains the distribution cylinder, and is composed of a widened cylindrical head which is connected to an also cylindrical body having a smaller cross section.

An axial port crosses each sealing element and, depending on the position of the sealing element, it connects the ports of the disribution cylinder respectively to the induction port of the combustion chamber, to the exhaust port of the chamber, to the induction manifold and with the exhaust manifold.

The body and the head of each sealing element are provided with perimetral grooves for sliding elements which provide a seal on the accommodation seat.

The sealing elements, arranged between the combustion chamber and the distribution cylinder, furthermore require spring members that bias them against the surface of the distribution cylinder.

However, a rotary-cylinder timing system of the type described above has some disadvantages causes mainly by the considerable number of sealing elements, usually four times the number of the cylinders of the engine, and by the consequent constructive complications.

Other disadvantages are due to the high friction which occurs between the large surfaces which are in sliding contact.

The need to arrange at least two sealing elements for each combustion chamber furthermore compromises the possibility of providing large induction and exhaust ports due to the small space available.

SUMMARY OF THE INVENTION

The aim of the present invention is to provide a sealing element for a rotary timing system of internal-combustion engines which eliminates the disadvantages described above in the known art.

A consequent primary object is to provide a sealing element which allows to provide constructively simpler rotary timing systems.

Another important object is to reduce the number of parts that normally constitute a rotary timing system for internal-combustion engines.

Another object is to reduce the friction occuring in the known rotary timing systems for internal-combustion engines while reducing the absorbed power.

This aim, these objects and others which will become apparent hereinafter are achieved by a sealing element for a rotary timing system of internal-combustion engines comprising a case associated with at least one combustion chamber of a cylinder of an engine, said case being furthermore connected to induction and exhaust manifolds, said case comprising a rotary distribution cylinder, said distribution cylinder having internal chambers and ports, said ports being adapted to selectively connect said internal chambers to said manifolds and to said at least one combustion chamber, a said sealing element being arranged at said case between said distribution cylinder and said combustion chamber, and a said sealing element being arranged between said distribution cylinder and said manifolds to connect said ports respectively to said combustion chamber and to said manifolds, characterized in that said sealing element comprises a head and a body, said head having a face shaped according to said distribution cylinder, said distribution cylinder being adapted to rotate and slide on said element face, said body of said element bein arranged in a seat provided in said case at said combustion chamber and at said manifolds, said head and said body having at least two parallel ports, a first port of said parallel ports being adapted to connect said combustion chamber with said induction manifold through at least one of said internal chambers, a second port of said parallel ports being adapted to connect said combustion chamber to said exhaust manifold through at least one of said internal chambers.

BRIEF DESCRIPTION OF THE DRAWINGS

Further characteristics and advantages of the invention will become apparent from the detailed description of a preferred embodiment thereof. Illustrated only by way of non-limitative example in the accompanying drawings, wherein.

DESCRIPTION OF THE PREFERRED EMBODIMENTS

Figure 1:
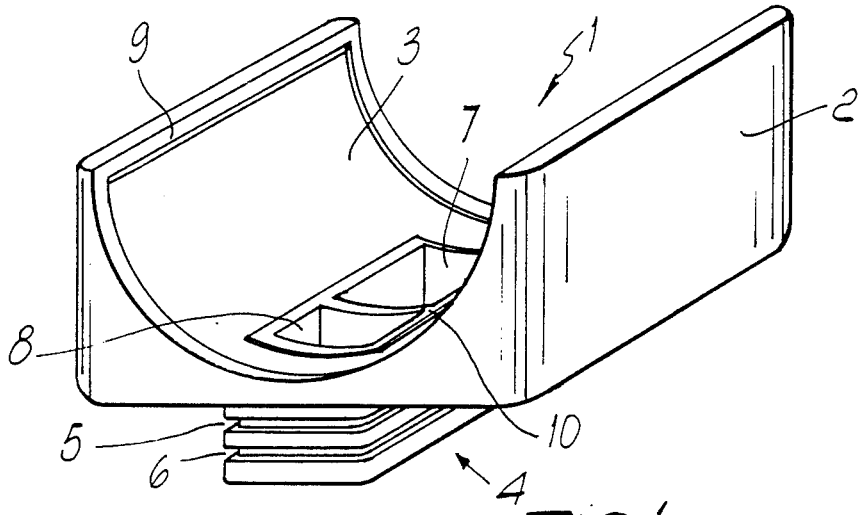
FIG. 1 is an isometric view of the sealing element according to the invention.
Figure 2:
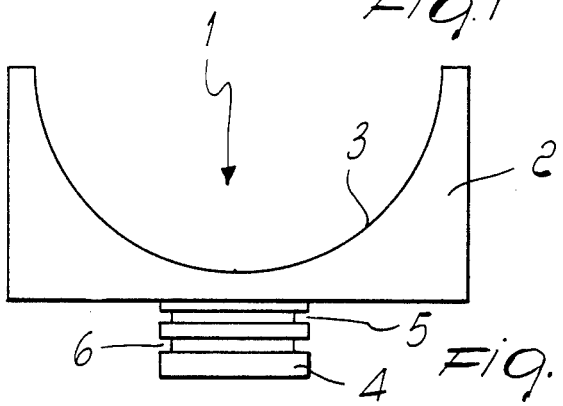
FIG. 2 is a front view of the element.
Figure 3:
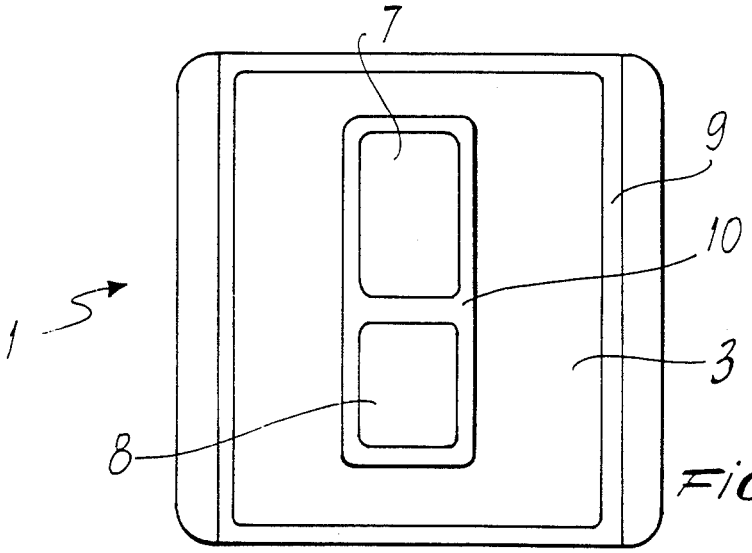
FIG. 3 is a top view of the element.

With reference to the above described figures, a sealing element according to the invention is generally indicated by the reference numeral 1 and comprises a widened head 2 which has a substantially square cross section; the upper concave face 3 of said head has the shape of a portion of cylindrical surface.

A body 4 is connected to said widened head 2 and is monolithic therewith; said body has a substantially rectangular cross section with rounded corners and is perimetrically provided with two grooves, respectively 5 and 6, for elastic rings which constitute sliding seals on the accommodation seat.

According to the invention, said sealing element 1 is axially provided with two parallel ports, respectively 7 and 8, both ports having a cross section of quadrangular shape but differing in size.

Said ports 7 and 8 are arranged so that their longer sides are longitudinal to said face 3 and therefore have minimum axial dimensions.

As shown in the figures, said face 3 is internally machined and is lowered with respect to its perimentral edges 9 and to the edges 10 of said ports 7 and 8.

Figure 6:
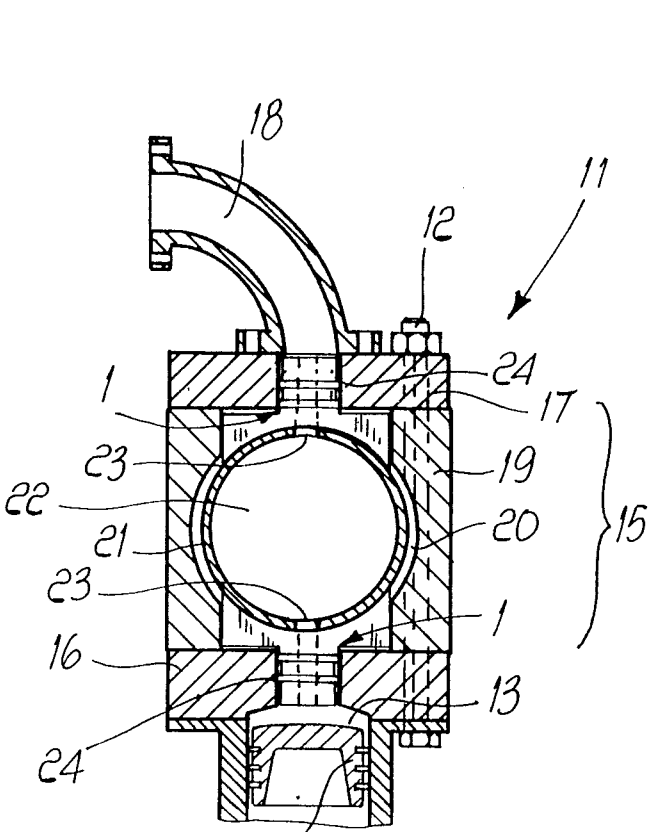
FIG. 6 is a schematic side sectioned view of a rotary timing system of an internal-combustion engine provided with sealing elements according to the invention.
Figure 4:
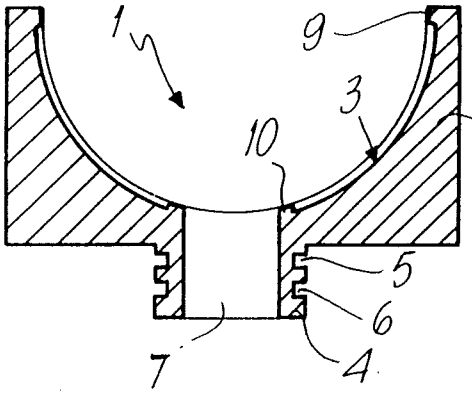
FIG. 4 is a sectional view of FIG. 2.
Figure 5:
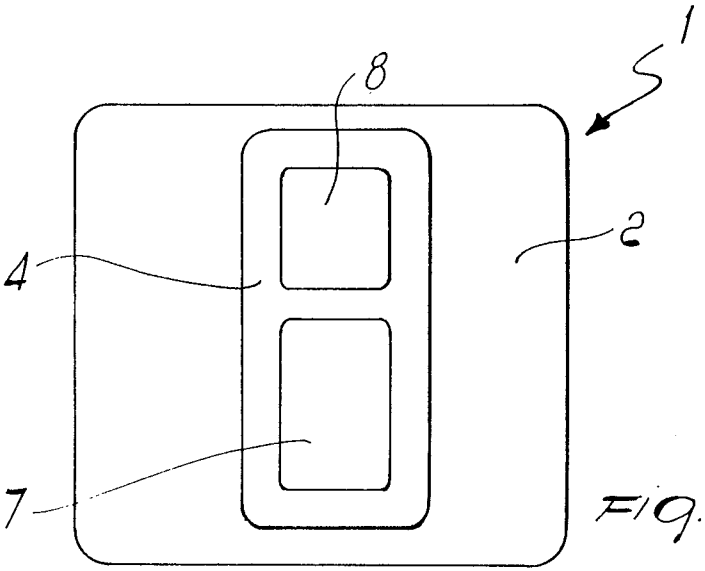
FIG. 5 is a bottom view of the element.

As is schematically illustrated in FIG. 6, sealing elements 1 are a part of a rotary timing system for internal-combustion engine which is generally indicated by the reference numeral 11 and is fixed, for example by means of stud bolts, 12, above the combustion chambers 13 of the cylinders 14 of the engine.

In particular, the rotary timing system 11 is composed of a case 15 having a first plate 16 on the combustion-chamber side and a second plate 17 on the manifold side 18.

Said case 15 is substantially constituted by a parallelepipedal element 19 with a median through port 20 in which a distribution cylinder 21 is arranged; said cylinder is internally divided into a plurality of chambers 22, two for each cylinder 14, and this division is obtained by interposing partitions in said cylinder 21.

Said chambers 22 are arranged two by two at each combustion chamber 13 of the engine.

The outer wall of the distribution cylinder 21 is conveniently provided with at least two ports 23 for each chamber 22.

Said sealing elements 1 are located between the cylinder 21 and the combustion chamber 13 and between the cylinder 21 and the manifolds 18 at each ideal line of rotation of the ports 23; the ports 7 and 8 of said sealing elements 1 constitute induction and exhaust ducts respectively.

By means of the edges 9 and 10, each head 2 is in contact with the surface of said distribution cylinder 21, while the bodies 4 are accommodated in ports 24 and 25 which are defined respectively on said first plate 16 and on said second plate 17 and may slide therein.

For a correct operation of the sealing element 1, there is advantageously some play between the head 2 and plates 16 and 17 to allow the sealing element to slide in the seats 24 while the edges 9 and 10 remain in contact with the distribution cylinder.

Said distribution cylinder 21 is actuated by the engine shaft to which it is kinematically connected.

The operation of the rotary timing system 11 is known and is mentioned herein for the sake of descriptive completeness.

In practice, the distribution cylinder 21 is provided with a plurality of ports which are arranged so that they can move toward the sealing elements 1, the ports 7 and 8 whereof connect each chamber 22 to the corresponding combustion chamber 13 or to the corresponding induction or exhaust manifolds.

The provision of the sealing elements 1 according to the invention is of considerable advantage in the design of the rotary timing system 11, since in practice each element has the double function of induction duct and exhaust duct, thus halving the number of sealing elements required.

Another advantage resides in the fact that it is now possible to use the entire space above the combustion chamber, thus providing large induction and exhaust ports therein.

With the adoption of the sealing element according to the invention, in particular above the combustion chamber, the spring adapted to compress it against the distribution cylinder are no longer required, because of the larger surfaces on which the compressed gases act inside the combustion chamber and the resultant thrust forces press the sealing element against the cylinder.

The particular configuration of the face, which is in contact with the distribution cylinder, contributes to minimize the contact surfaces, and therefore the sliding frictions, while simultaneously reducing the power absorbed by the timing system.

All this finally increases the output power which can be obtained from internal-combustion engines with rotary timing system.

In practice it has been observed that the invention has brilliantly achieved the intended aim and objects.

The invention thus conceived is susceptible to numerous modifications and variations, all of which are within the scope of the inventive concept.

Figure 7:
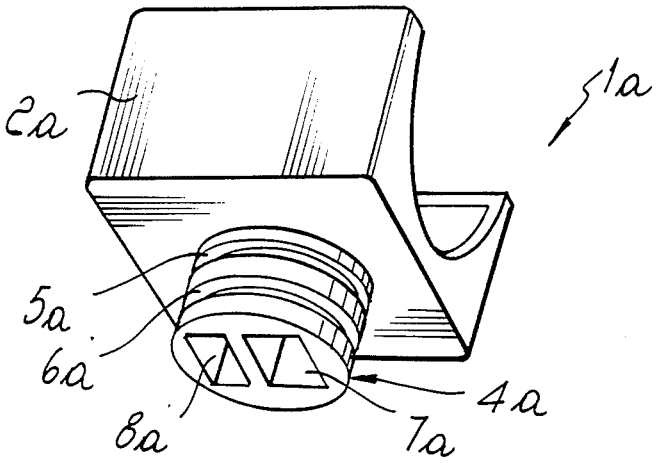
FIGS. 7 and 8 are isometric views of sealing elements according to two further aspects of the invention.
Figure 8:
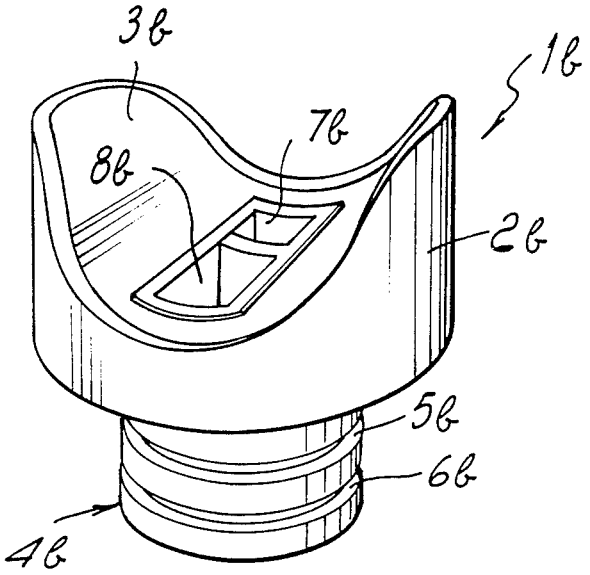

For example, as clearly illustrated in FIGS. 7 and 8, the sealing element may be shaped differently.

In FIG. 7, the body 4*a* has a circular cross section, and, in FIG. 8, both the body 4*b* and the head 2*b* have cylindrical shapes.

Naturally, the corresponding seats 24 and the other related elements of the case 15 will have shapes formed according to the sealing elements 1*a* or 1*b*.

All the details may furthermore be replaced with other technically equivalent elements.

In practice, the materials employed, as well as the dimension, may be any according to the requirements.

I claims:

1. Sealing element for a rotary timing system of internal-combustion engines comprising a case associated with at least one combustion chamber of a cylinder of an engine, said case being furthermore connected to induction and exhaust manifolds, said case comprising a rotary distribution cylinder, said distribution cylinder having internal chambers and ports, said ports being adapted to selectively connect said internal chambers to said manifolds and to said at least one combustion chamber, a said sealing element being arranged at said case between said distribution cylinder and said combustion chamber, and a said sealing element being arranged between said distribution cylinder and said manifolds to connect said ports respectively to said combustion chamber and to said manifolds, wherein said sealing element comprises a head and a body, said head having a face shaped according to said distribution cylinder, said distribution cylinder being adapted to rotate and slide on said element face, said body of said element being arranged in a seat provided in said case at said combustion chamber and at said manifolds, said head and said body having at least two parallel ports, a first port of said parallel ports being adapted to connect said combustion chamber with said induction manifold through at least one of said internal chambers, a second port of said parallel ports being adapted to connect said combustion chamber to said exhaust manifold through at least one of said internal chambers.

2. Sealing element according to claim 1, wherein said body is provided with perimetral grooves for elastic rings adapted to provide a seal with said seats of said case.

3. Sealing element according to claim 1, wherein said face of said head is internally machined and is lowered with respect to perimetral edges of said face and to edges of said ports.

4. Sealing element according to claim 1, wherein said head has a substantially square cross section with rounded corners.

5. Sealing element according to claim 1, wherein said body has a substantially rectangular cross section with rounded corners and is arranged longitudinally with respect to said face.

6. Sealing element according to claim 1, wherein each of said at least two ports has a substantially quadrangular cross section and at least two longer sides, each of said ports being arranged so that said longer sides are longitudinal to said face.

7. Sealing element according to claim 1, wherein said at least two ports have different cross sections, one of said ports constituting an induction duct, another one constituting an exhaust duct for said cylinder of said engine.

* * * * *